US008011121B2

(12) United States Patent
Daraie et al.

(10) Patent No.: US 8,011,121 B2
(45) Date of Patent: Sep. 6, 2011

(54) SPREAD-STYLE COUPLER WITH SUPPLEMENTAL SAFETY LOCK

(75) Inventors: Shadruz Daraie, Copley, OH (US); Robert Sikorski, Tallmadge, OH (US)

(73) Assignee: Paladin Brands Group, Inc., Cedar Rapids, IA (US)

( * ) Notice: Subject to any disclaimer, the term of this patent is extended or adjusted under 35 U.S.C. 154(b) by 133 days.

(21) Appl. No.: 12/537,578

(22) Filed: Aug. 7, 2009

(65) Prior Publication Data

US 2010/0031539 A1 Feb. 11, 2010

Related U.S. Application Data

(60) Provisional application No. 61/086,931, filed on Aug. 7, 2008.

(51) Int. Cl.
*E02F 3/96* (2006.01)

(52) U.S. Cl. ..... 37/468; 37/444; 414/723; 403/321; 403/322.1

(58) Field of Classification Search ..... 37/468, 37/403, 444; 414/723, 724; 403/321, 322.1; 172/272, 273, 275
See application file for complete search history.

(56) References Cited

U.S. PATENT DOCUMENTS 4,632,595 A * 12/1986 Schaeff ..... 403/330
4,881,867 A * 11/1989 Essex et al. ..... 414/723
5,082,389 A * 1/1992 Balemi ..... 403/322.3
5,179,794 A * 1/1993 Ballinger ..... 37/468
5,423,625 A * 6/1995 Gebauer et al. ..... 403/322.3
5,456,030 A * 10/1995 Barone et al. ..... 37/468
5,549,440 A 8/1996 Cholakon et al.
5,692,325 A 12/1997 Kuzutani
5,890,871 A 4/1999 Woerman
6,058,633 A * 5/2000 Barden ..... 37/468
6,132,131 A 10/2000 Nakamura et al.
6,308,442 B1 * 10/2001 Naka et al. ..... 37/468
6,379,075 B1 * 4/2002 Shamblin et al. ..... 403/322.1
6,422,805 B1 7/2002 Miller
6,431,785 B1 8/2002 Melander
6,481,124 B1 11/2002 Miller et al.
6,508,616 B2 1/2003 Hung
6,688,801 B2 * 2/2004 Husson ..... 403/322.1
6,691,438 B2 2/2004 Fatemi
6,699,001 B2 3/2004 Fatemi
6,881,002 B2 4/2005 Fatemi (Continued)

FOREIGN PATENT DOCUMENTS

WO WO 2008/029112 3/2008

*Primary Examiner* — Thomas A Beach
(74) *Attorney, Agent, or Firm* — Fay Sharpe LLP

(57) ABSTRACT

A coupler for a backhoe or other excavator includes a frame with a lock system including a first safety lock that moves relative to a first hook between an engaged position for capturing the first associated attachment pin in the first hook and a disengaged position for releasing the first associated attachment pin from the first hook. An actuator moves the first safety lock between its engaged and disengaged positions. At least a first lock arm is movable between a locked position and an unlocked position. The first lock arm engages and retains the first safety lock in its engaged position when the first lock arm is in its locked position. The first lock arm is movable to its unlocked position by contact with the associated backhoe or excavator arm when the frame is moved to a curled position relative to the associated backhoe or excavator arm.

19 Claims, 6 Drawing Sheets

U.S. PATENT DOCUMENTS

| | | | | |
|---|---|---|---|---|
| 6,902,346 | B2 | 6/2005 | Steig, Jr. et al. | |
| 6,962,475 | B2 | 11/2005 | Fatemi | |
| 6,964,122 | B2 | 11/2005 | Cunningham et al. | |
| 6,996,926 | B2 * | 2/2006 | Fatemi | 37/468 |
| 7,032,335 | B2 * | 4/2006 | Short | 37/468 |
| 7,306,395 | B2 | 12/2007 | Fatemi | |
| 7,426,796 | B2 | 9/2008 | Cunningham et al. | |
| 7,473,067 | B2 * | 1/2009 | Nishioka et al. | 414/723 |
| 7,493,712 | B2 * | 2/2009 | McCormick et al. | 37/468 |
| 7,594,776 | B2 * | 9/2009 | Steig et al. | 403/322.3 |
| 7,648,305 | B2 * | 1/2010 | Beales | 403/322.1 |
| 7,744,301 | B2 * | 6/2010 | Fatemi | 403/322.1 |
| 7,797,862 | B2 * | 9/2010 | Daraie et al. | 37/468 |
| 2005/0214105 | A1 * | 9/2005 | Steig et al. | 414/723 |
| 2007/0157492 | A1 | 7/2007 | Miller et al. | |
| 2007/0166143 | A1 * | 7/2007 | Hart et al. | 414/723 |
| 2008/0067784 | A1 | 3/2008 | Calvert et al. | |

* cited by examiner

SPREAD-STYLE COUPLER WITH SUPPLEMENTAL SAFETY LOCK

CROSS-REFERENCE TO RELATED APPLICATION

This application claims priority from and benefit of the filing date of U.S. Provisional Application Ser. No. 61/086,931 filed Aug. 7, 2008, and the entire disclosure of said provisional application Ser. No. 61/086,931 is hereby expressly incorporated by reference into the present specification.

BACKGROUND

Couplers are known for securing construction attachments such as buckets, impact hammers, shears, etc. fixedly and operatively to the distal end of an arm of a tractor, backhoe, excavator or other type of arm-equipped construction/agricultural equipment (any such tractor, backhoe, excavator or the like referred to herein as an "excavator"). As is generally known, these couplers, also referred to as "quick couplers," are used as an alternative to a pin-on connection for fixedly and operatively securing an attachment to the distal end of an arm which is, in turn, secured to a boom of a construction/agricultural machine such as a backhoe or other excavator. Over the years, the safety of such couplers has been greatly improved with respect to minimizing the chance for equipment failure and/or operator error leading to accidental decoupling of the construction attachment, and the present development is directed to a coupler with new and improved safety features.

SUMMARY

In accordance with one aspect of the present development, a coupler for a backhoe or other excavator includes a frame including an upper portion and a lower portion. The upper portion is adapted to be secured to an associated backhoe or excavator arm. The lower portion includes a first hook adapted to mate releasably with a first associated attachment pin and includes a second hook adapted to mate releasably with a second associated attachment pin. A lock system includes at least a first safety lock that is movably connected to the frame and that moves relative to the first hook between an engaged position for capturing the first associated attachment pin in the first hook and a disengaged position for releasing the first associated attachment pin from the first hook. An actuator is adapted to move the first safety lock selectively between its engaged and disengaged positions. At least a first lock arm is movably connected to the frame. The first lock arm is movable between a locked position and an unlocked position. The first lock arm engages and retains the first safety lock in its engaged position when the first lock arm is in its locked position. The first lock arm is selectively movable from its locked position to its unlocked position by contact between a portion of the first lock arm and the associated backhoe or excavator arm when the frame is moved to a curled position relative to the associated backhoe or excavator arm.

In accordance with another aspect of the present development, an attachment coupler includes a frame. The frame includes a first hook adapted to mate with a first associated attachment pin and a second hook adapted to mate with a second associated attachment pin. The second hook is movable toward and away from the first hook. A safety lock is movably connected to the frame and moves relative to the first hook between an engaged position where it blocks the first hook and a disengaged position where it opens the first hook. An actuator is operably connected between the second hook and the safety lock. The actuator is adapted to move the second hook toward and away from the first hook and is adapted to move the safety lock between its engaged and disengaged positions. A lock arm is movably connected to the frame and moves between a locked position and an unlocked position. The lock arm engages and retains the safety lock in its engaged position when the lock arm is in its locked position. The lock arm is selectively movable from its locked position to its unlocked position by contact between the lock arm and an associated backhoe or excavator arm when the frame is moved to a curled position.

DETAILED DESCRIPTION

Figure 1:
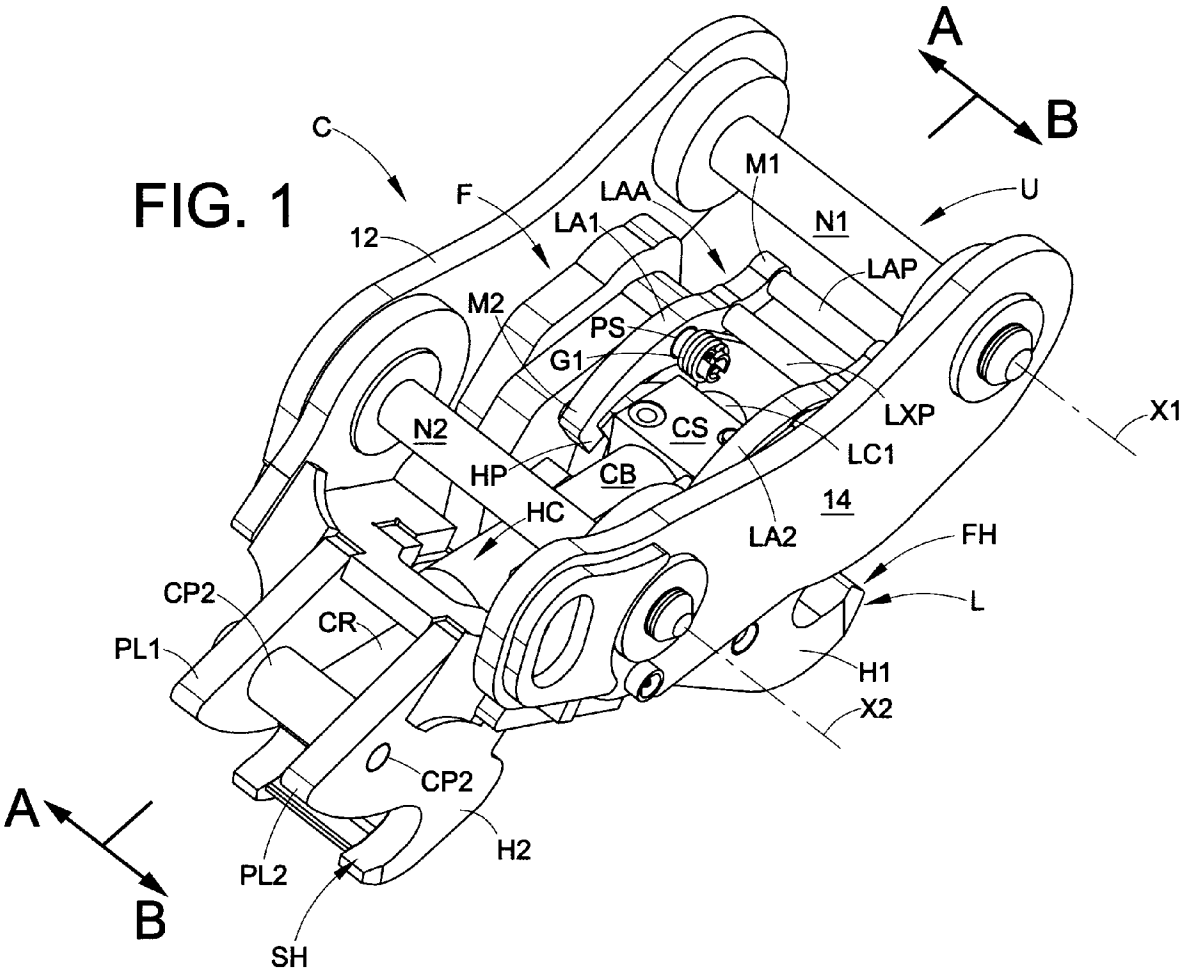
FIG. 1 is an isometric view of a coupler formed in accordance with the present development.
Figure 2:
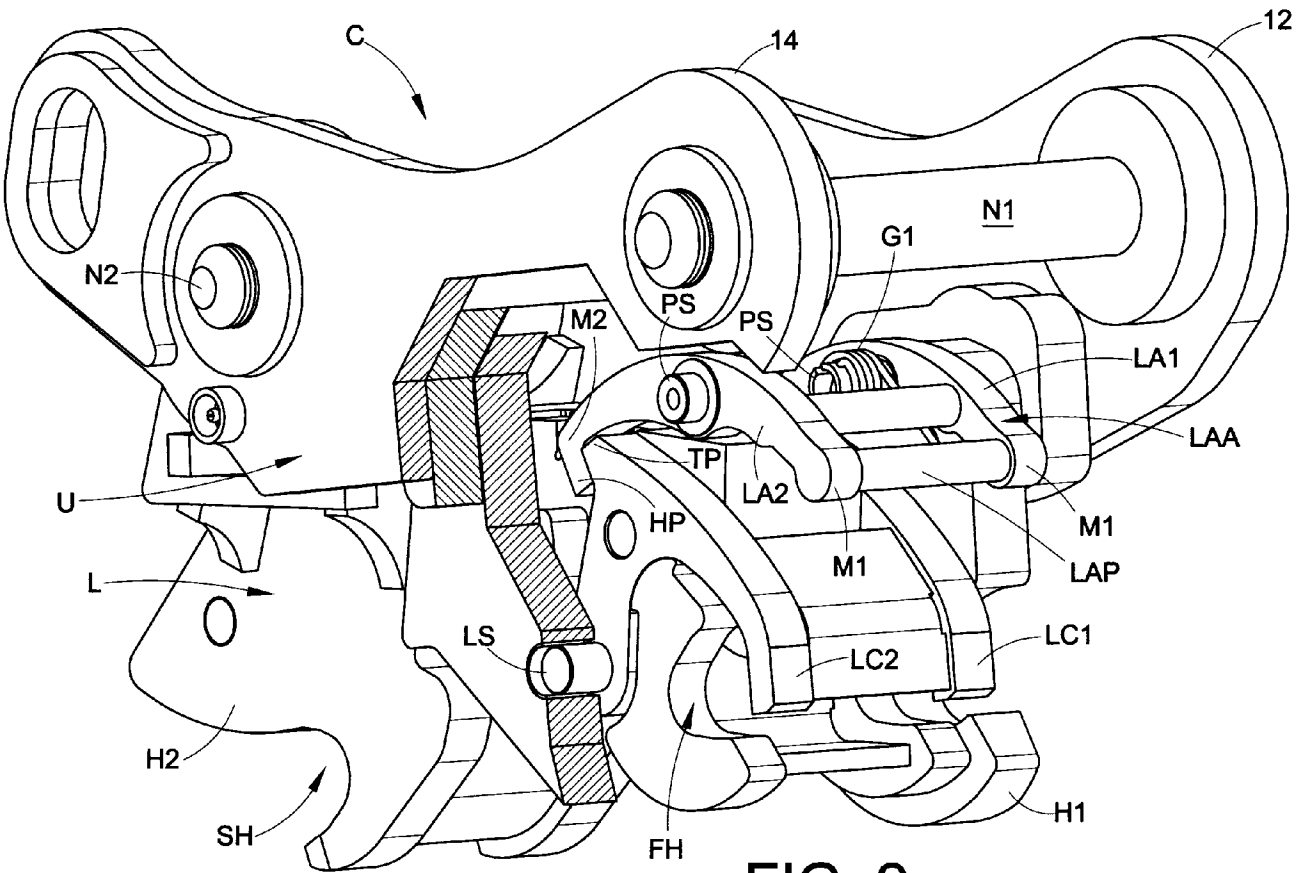
FIG. 2 is another isometric view of the coupler of FIG. 1, with a portion broken away to reveal underlying components.
Figure 2A:
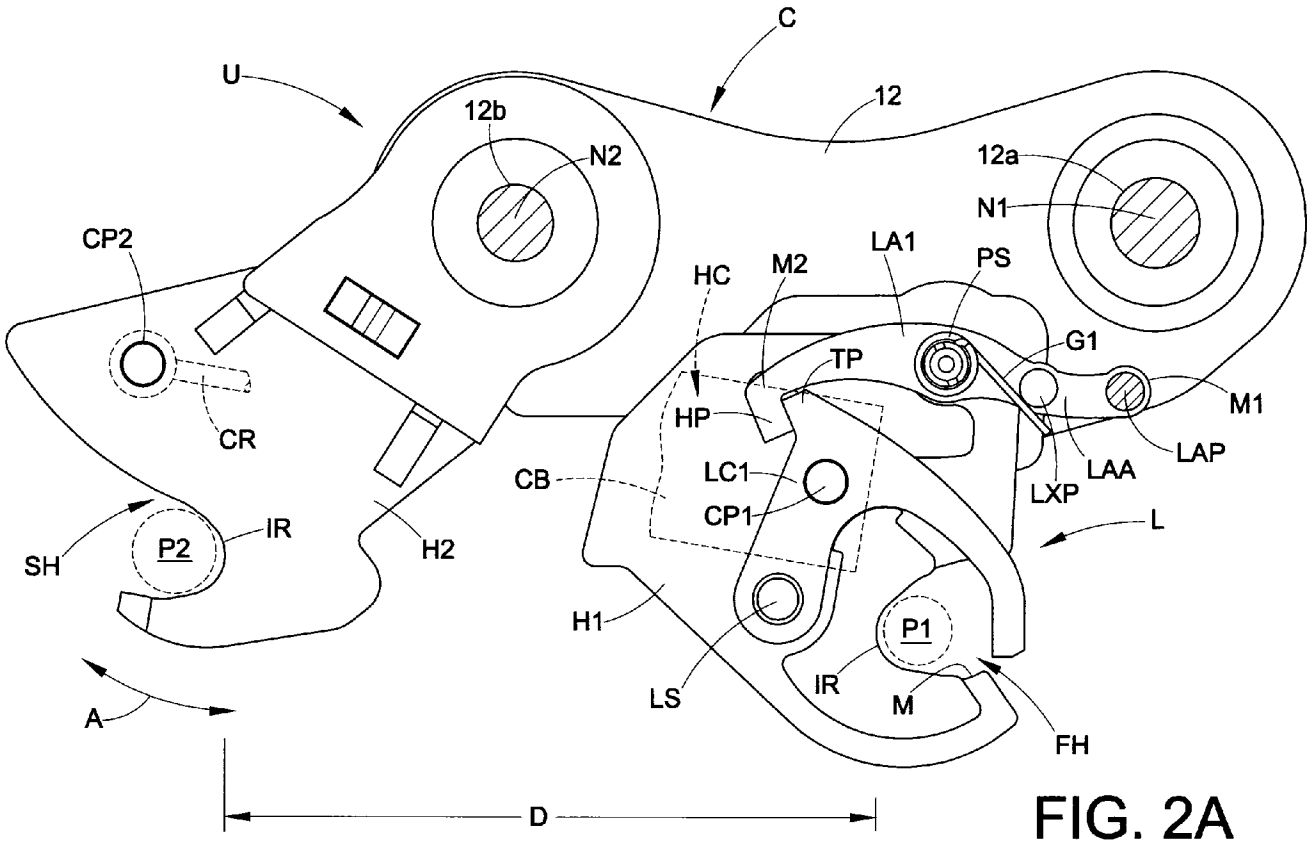
FIGS. 2A and 2B are respective simplified sectional views as taken along lines A-A and B-B of FIG. 1.
Figure 2B:
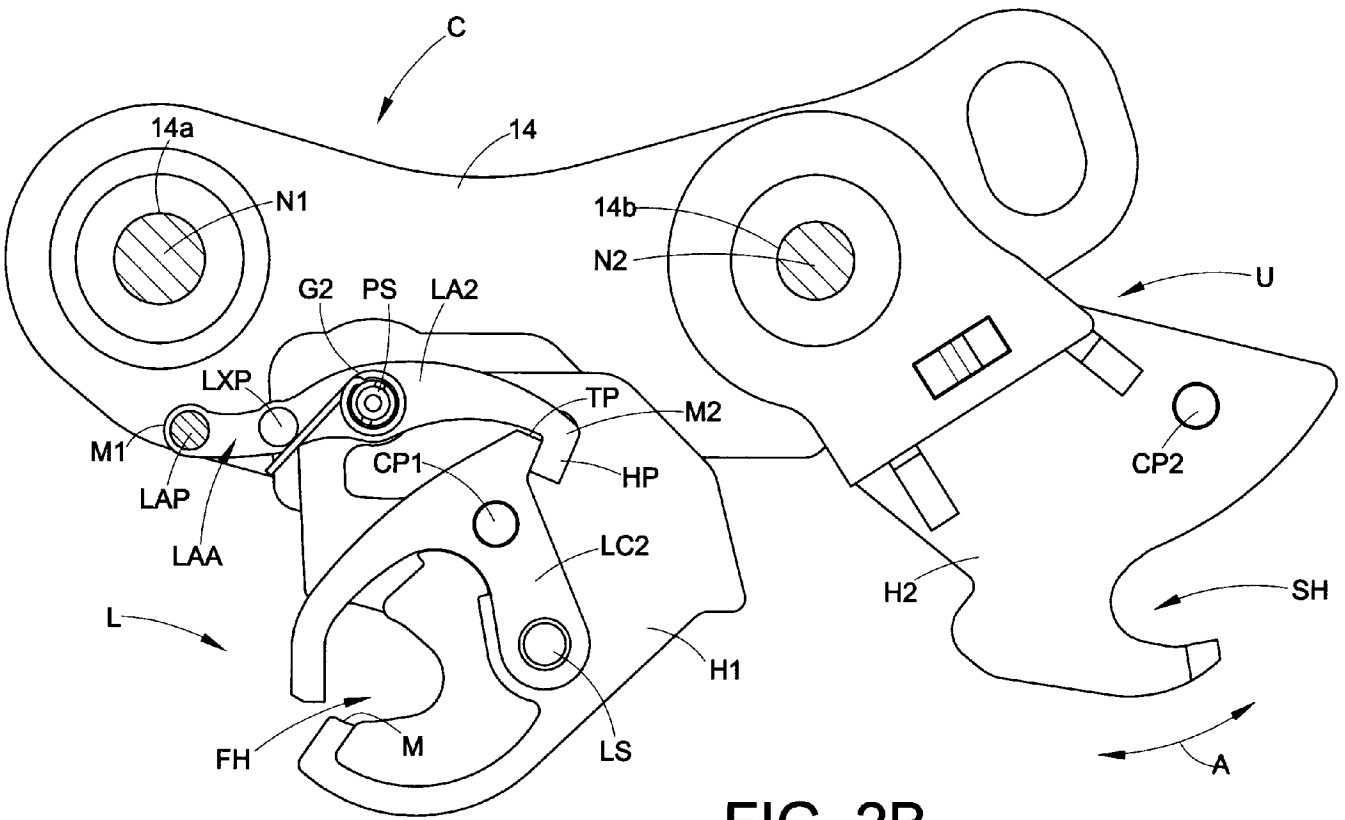
Figure 3:
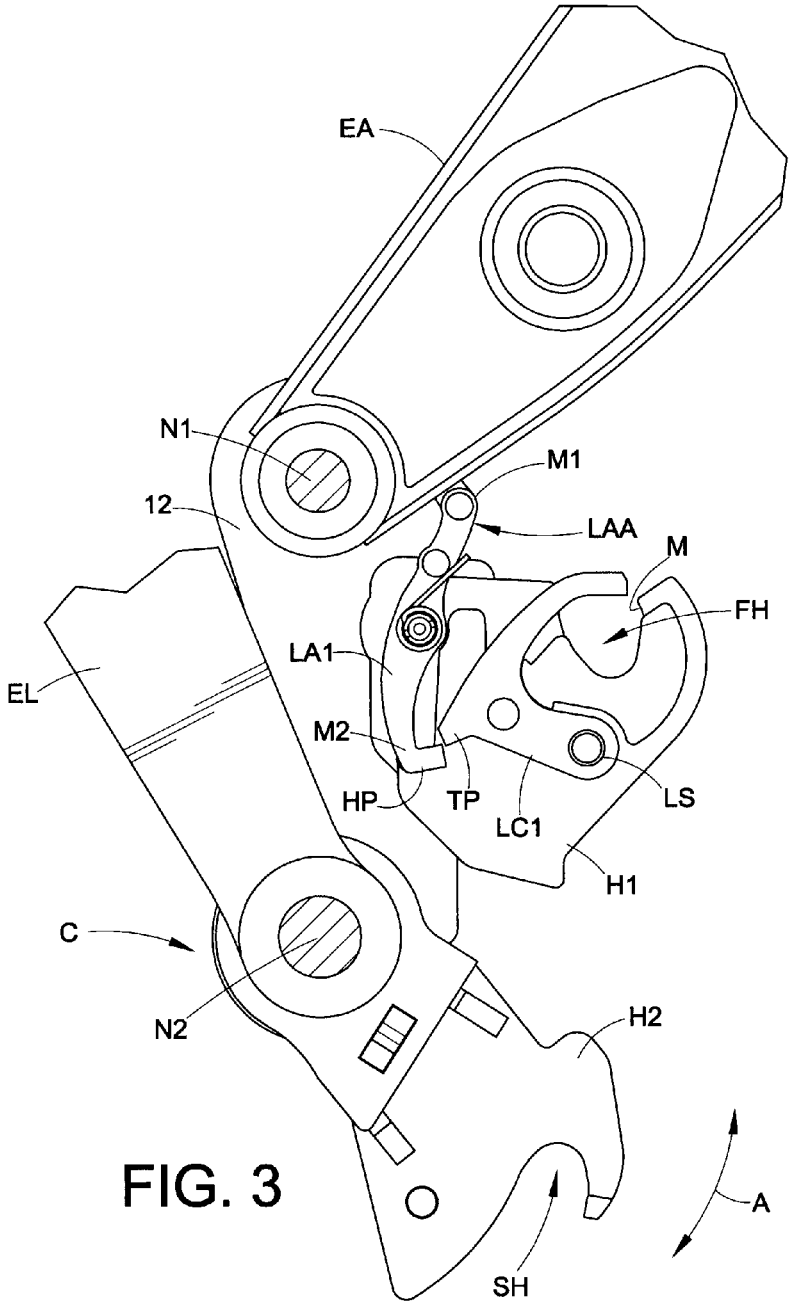
FIGS. 3 and 4 show the coupler connected to the arm of a backhoe or other excavator and moved to a curled position in which the safety locks can be moved from the engaged position (FIG. 3) to the disengaged position (FIG. 4).
Figure 4:
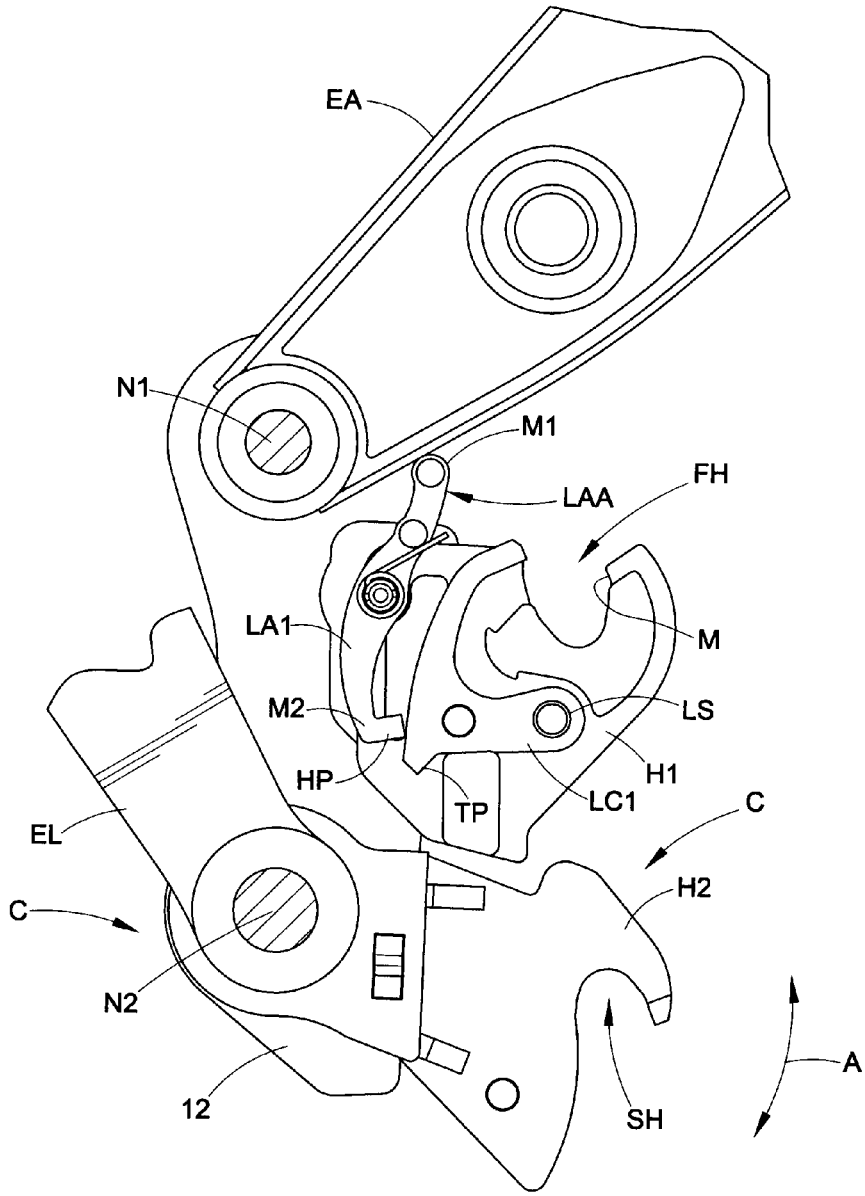

FIGS. 1 and 2 are isometric views of a coupler C formed in accordance with the present development. FIGS. 2A and 2B are respective simplified sectional views as taken along lines A-A and B-B of FIG. 1. As shown in FIGS. 3 and 4, the coupler C is adapted for operative connection to the arm EA or "dipper stick" and also a control link EL of an excavator or backhoe (excavator and backhoe are interchangeably referred to herein as an "excavator").

The coupler C comprises a frame F comprising an upper portion U adapted to be secured to the associated excavator arm EA and control link EL, and a lower portion L connected to the upper portion U and adapted to be releasably coupled to a bucket or other attachment having first and second parallel, spaced-apart attachment pins P1,P2 (FIG. 2A). FIGS. 3 and 4 are similar to FIG. 2A, but show the coupler C operatively connected to the excavator arm EA and control link EL, with the coupler C in a curled position as required to pivot its lock arm assembly LAA (including one or more lock arms LA1, LA2) from a locked position (FIGS. 2A,2B) to an unlocked position (FIGS. 3 and 4) to allow movement of one or more safety locks LC1,LC2 from an engaged position (FIG. 3) to a disengaged position (FIG. 4). FIGS. 3 and 4 show only the first safety lock LC1, but the second safety lock LC2 is structured and functions in an identical manner.

Referring specifically again to FIG. 1, the upper portion U of the coupler comprises first and second parallel, spaced-part upper ribs 12,14 comprising respective first apertures 12*a*, 14*a* and second apertures 12*b*,14*b* respectively aligned with each other and centered on respective pin-on axes X1,X2. The coupler 10 is adapted to receive the excavator arm EA and excavator control link EL in the channel defined between the upper ribs 12,14, with the excavator arm EA pivotally secured to the coupler 10 by a first excavator pin N1 received through the excavator arm and the aligned first apertures of ribs 12,14, and with the excavator control link EL pivotally secured to the coupler 10 by a second excavator pin N2 received through the excavator control link and the aligned second apertures of the ribs 12,14 as shown in FIGS. 3 and 4. The ribs 12,14 can be one-piece or multi-piece components defined from steel castings and/or plates or the like.

The lower portion L of the coupler 10 is adapted to be releasably coupled to or mated with a bucket or other attachment that includes parallel, spaced-apart first and second attachment pins P1,P2 (see FIG. 2A). The lower coupler portion L comprises a first hook assembly H1 comprising a first open recess or hook FH adapted for receipt of the first attachment pin P1. The lower coupler portion L further comprises a second hook assembly H2 comprising a second open recess or hook SH. The first and second hooks FH,SH open outwardly away from each other in opposite directions. The first hook assembly H1 is fixed in position relative to the upper portion U, while the second hook assembly H2 is movable as described further below. As such, the first hook FH is fixed in position relative to the first and second pin-on axes X1,X2 of the upper portion U, and the second hook SH is movable relative to the first hook FH and also relative to the first and second pin-on axes X1,X2. The first and second hook assemblies H1,H2 can be one-piece or multi-piece components defined from steel castings and/or plates or the like.

The coupler C further comprises a lock assembly or lock system including one or more safety locks LC1 (FIG. 2A) and LC2 (FIG. 2B) that are movably connected to the coupler frame F and that move relative to the first hook FH between an engaged position (FIGS. 2A,2B,3) and a disengaged position (FIG. 4). In the illustrated embodiment, the first and second safety locks LC1,LC2 are located respectively adjacent opposite first and second lateral sides of the first hook FH and are pivotally connected to the first hook assembly H1. As shown herein, the first and second safety locks LC1,LC2 are interconnected and can alternatively be considered as a single safety lock. In the illustrated example, the safety locks LC1, LC2 are pivotally connected to the first hook assembly H1 by respective pivot shafts LS. In the engaged position, the safety locks LC1,LC2 are extended and at least partially (and preferably substantially completely) obstruct or block an open mouth M of the first hook FH to prevent insertion or escape of the first attachment pin P1 from the first hook FH. Thus, in the engaged position, the safety locks capture the first attachment pin P1 in the first hook FH. In the disengaged position shown in FIG. 4, the safety locks LC1,LC2 are retracted to open the mouth M of the first hook FH sufficiently to allow insertion in or removal from or release of the first attachment pin P1 relative to the first hook FH.

The second hook assembly H2 comprising the second hook SH is movably connected to the upper portion U of the frame F and moves selectively toward and away from the first hook assembly H1. In the illustrated embodiment, the second hook assembly H2 is pivotally connected to the frame upper portion U and pivots on an arc A about the second pin-on axis X2 that is coaxial with the second excavator pin N2. As such, a distance or spacing D between the respective innermost regions IR of the first and second hooks FH,SH is variable depending upon the position of the second hook assembly H2 on the arc A, as can be seen in a comparison of FIGS. 3 and 4.

An actuator is provided to selectively move the second hook assembly H2 on the arc A toward and away from the first hook assembly H1 and to control the position of the safety locks LC1,LC2. In the illustrated embodiment, the actuator comprises a double-acting hydraulic cylinder HC operably connected between the safety locks LC1,LC2 and the second hook assembly H2 (the hydraulic cylinder HC is visible in FIG. 1 and partially in FIG. 2A and has been omitted from other drawings to enhance clarity). Alternatively, the actuator can be a hydraulically driven or manually driven screw jack assembly or other selectively extensible and retractable structure. The illustrated hydraulic cylinder HC comprises a cylinder body CB including a base CS, and a rod CR that is selectively extensible from and selectively retractable into the cylinder body CB under force of hydraulic fluid acting on a piston contained in the body CB. The cylinder base CS is located between and is pivotally connected to the first and second safety locks LC1,LC2 at respective cylinder connection points CP1. The cylinder rod CR is operatively connected to the movable second hook assembly H2. For example, as shown, the cylinder rod CR is sandwiched between first and second plates PL1,PL2 and to respective rod connection points CP2 thereof. As such, when the hydraulic cylinder HC is pressurized to extend the cylinder rod CR (or when an alternative actuator is operated in a corresponding manner), the second hook assembly H2 pivots on the arc A away from the first hook assembly H1 and the safety locks LC1,LC2 pivot to their engaged positions (the coupler is preferably configured such that the second hook assembly H2 pivots away from the first hook assembly H1 before the safety locks LC1,LC2 pivot to their engaged positions). Conversely, when the hydraulic cylinder HC is pressurized to retract the cylinder rod CR (or when an alternative actuator is operated in a corresponding manner), the second hook assembly H2 pivots on the arc A toward the first hook assembly H1 and the safety locks LC1,LC2 pivot to their disengaged positions (the coupler is preferably configured such that the second hook assembly H2 pivots toward the first hook assembly H1 before the safety locks LC1,LC2 pivot to their disengaged positions).

The coupler C further comprises a lock arm assembly LAA comprising at least one lock arm LA1,LA2 that is movably connected to the first hook assembly and/or to the upper portion U for selectively engaging at least a corresponding/respective one of the safety locks LC1,LC2. Preferably, as shown, the coupler C comprises a lock arm assembly LAA comprising both first and second interconnected lock arms LA1,LA2 (see FIGS. 1, 2A and 2B) corresponding respectively to and selectively engaging the first and second safety locks LC1,LC2. The first and second lock arms LA1,LA2 are located respectively adjacent opposite first and second lateral sides of the first hook assembly H1 and are pivotally connected to the frame F, e.g., to the first hook assembly H1 and/or to the upper portion U of the coupler, so as to pivot about respective pivot shafts PS. Each lock arm LA1,LA2 is movable to and between a locked position (FIGS. 2, 2A, 2B) and an unlocked position (FIGS. 3 and 4). Each lock arm LA1,LA2 is continuously spring-biased toward the locked position and selectively movable against the biasing force to the unlocked position. In this regard, the coupler C comprises a spring associated with each lock arm LA1,LA2, such as the illustrated torsion springs G1,G2 acting between the respective lock arms LA1,LA2 and the shaft PS on which each lock arm is pivoted or other fixed portion of the coupler frame F. As shown, the torsion springs G1,G2 are engaged at one end with the respective lock arm pivot shaft PS about which the spring is located and at the opposite end with a cross-pin LXP that extends between and interconnects the first and second lock arms LA1,LA2 of the lock arm assembly LAA.

Each lock arm LA1,LA2 comprises an outer end M1 that projects from its respective pivot shaft PS outwardly away from the first hook assembly H1. Each lock arm LA1,LA2 also comprises an inner end M2 that extends from its respective pivot shaft PS further into the first hook assembly H1 (toward the second hook assembly H2) so as to be located to selectively engage the respective or corresponding safety lock LC1,LC2 when the lock arm LA1,LA2 is in its locked position and when the safety lock LC1,LC2 is in its engaged position. The outer ends M1 of the lock arms LA1,LA2 can be interconnected as shown by a lock arm actuator pin LAP or other member extending therebetween, in which case the lock arm actuator pin LAP is deemed to be part of the inner end M1 of both lock arms LA1,LA2. The first and second lock arms LA1,LA2 need not be interconnected as an assembly LAA and can alternatively be structured to be completely separate from each other and to move independently from each other.

The inner end M2 of each lock arm LA1,LA2 includes a hooked end portion HP that engages or receives and retains a projecting tail portion TP of the corresponding safety lock LC1,LC2 when the safety lock LC1,LC2 is engaged and the lock arm LA1,LA2 is in its locked position. When each lock arm LA1,LA2 is latched/engaged with its corresponding safety lock LC1,LC2 as shown in FIGS. 2A,2B, the safety lock LC1,LC2 cannot be moved by the hydraulic cylinder HC or other actuator from its engaged position to its disengaged position, which ensures that the attachment pin P1 seated in the first hook FH cannot escape. As shown in FIG. 3, on the other hand, when the lock arms LA1,LA2 are moved to their unlocked positions, the hooked end portions HP thereof are unlatched/disengaged from the tail portion TP of the respective corresponding safety locks LC1,LC2 so that the safety locks are free to move from their engaged positions to their disengaged positions under control of the hydraulic cylinder HC or other actuator so as to allow the first attachment pin P1 to escape the first hook FH during attachment decoupling (and to allow the first attachment pin P1 to enter the first hook FH during attachment coupling).

As noted, each lock arm LA1,LA2 is spring-biased into its locked position. In order to move the lock arm LA1,LA2 to its unlocked position, the coupler C is rotated about the excavator arm EA using the excavator control link EL to its curled position so that the outer end M1 (including the optional lock arm actuator pin LAP) of each lock arm LA1,LA2 contacts the excavator arm EA. After this initial contact between the outer end M1 of each lock arm LA1,LA2 and the excavator arm EA, further curling rotation of the coupler C causes each lock arm LA1,LA2 to pivot from its locked position to its unlocked position as shown in FIG. 3. When the lock arms LA1,LA2 are moved to their unlocked positions, the hydraulic cylinder HC or other actuator can move the first and second safety locks LC1,LC2 from their engaged positions (FIG. 3) to their disengaged positions (FIG. 4) (along with corresponding movement of the second hook assembly H2 toward the first hook assembly H1 as described above and as shown in FIG. 4).

With continuing reference to FIG. 4, it can be seen that the inner end M2 of each lock arm LA1,LA2 does not prevent movement of the corresponding safety lock LC1,LC2 from the disengaged position (FIG. 4) to the engaged position (FIG. 3). Instead, the corresponding safety lock LC1,LC2 will move relative to the inner end M2 of the lock arm LA1, LA2 until the safety lock LC1,LC2 is engaged sufficiently so that the hooked end portion HP of the corresponding lock arm LA1,LA2 can again become latched to the tail portion TP thereof when the lock arm LA1,LA2 is allowed to pivot back to its locked position under force of its spring G.

Those of ordinary skill in the art will recognize that operation of the coupler C to pick-up an attachment includes:

beginning with the coupler C as shown in FIG. 4 (once the safety locks LC1,LC2 are disengaged as shown, the coupler C can be rotated relative to the arm EA to any desired position);

rotating/maneuvering the coupler C so that the first attachment pin P1 is received in the first hook FH;

rotating/maneuvering the coupler C to align the second hook SH with the second attachment pin P2;

operating the actuator HC to move the second hook assembly H2 away from the first hook assembly H1 until the second attachment pin P2 is fully seated in the second hook SH and so that the safety locks LC1,LC2 are fully engaged (as shown in FIGS. 2A,2B) so that the attachment including the pins P1,P2 is fully operatively coupled to the coupler C.

To decouple the attachment, the attachment is moved to a safe decoupling position (close to the ground or other safe support surface) and:

the coupler C is first rotated relative to the excavator arm EA to the position shown in FIG. 3, to move the lock arms LA1,LA2 to their unlocked positions;

with the attachment safely supported on the ground or other surface, the actuator HC is operated to arrange the coupler C as shown in FIG. 4, where: (i) the second hook assembly H2 is moved toward the first hook assembly to disengage the second attachment pin P2 from the second hook SH; and (ii) the first and second safety locks LC1, LC2 are moved from their engaged positions to their disengaged positions to open the mouth M of the first hook FH;

the coupler C is rotated/maneuvered to separate the first hook FH from the first attachment pin P1.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

The invention claimed is:

1. A coupler for a backhoe or other excavator, said coupler comprising:

a frame including an upper portion and a lower portion, said upper portion adapted to be secured to an associated backhoe or excavator arm and said lower portion comprising a first hook adapted to mate releasably with a first associated attachment pin and comprising a second hook adapted to mate releasably with a second associated attachment pin;

a lock system comprising at least a first safety lock movably connected to the frame and movable relative to the first hook between an engaged position for capturing the first associated attachment pin in the first hook and a disengaged position for releasing the first associated attachment pin from the first hook;

an actuator adapted to move the first safety lock selectively between its engaged and disengaged positions;

at least a first lock arm movably connected to the frame, said first lock arm movable between a locked position and an unlocked position, wherein said first lock arm engages and retains said first safety lock in its engaged position when said first lock arm is in its locked position, said first lock arm selectively movable from its locked position to its unlocked position by contact between a portion of said first lock arm and the associated backhoe or excavator arm when the frame is moved to a curled position relative to the associated backhoe or excavator arm.

2. The coupler as set forth in claim 1, wherein said first hook is part of a first hook assembly and said second hook is part of a second hook assembly that is selectively movable by said actuator relative to said first hook assembly to control a spacing between said first and second hooks.

3. The coupler as set forth in claim 2, wherein said actuator is operably connected between said first safety lock and said second hook assembly such that said first safety lock moves from said disengaged position to said engaged position when said actuator is operative to move said second hook assembly away from said first hook assembly, and such that said first safety lock moves from said engaged position to said disengaged position when said actuator is operative to move said second hook assembly toward said first hook assembly.

4. The coupler as set forth in claim 3, wherein said first and second hooks open in opposite directions as compared to each other.

5. The coupler as set forth in claim 3, wherein said lock system further comprises a second safety lock movably connected to the frame and movable relative to the first hook between an engaged position for capturing the first associated attachment pin in the first hook and a disengaged position for releasing the first associated attachment pin from the first hook, wherein said second safety lock and said first safety lock are both connected to said actuator and move in unison between their respective engaged and disengaged positions.

6. The coupler as set forth in claim 5, wherein said actuator comprises a hydraulic cylinder including a body and a rod that is selectively extensible from and retractable into said body by hydraulic pressure, said body including a portion located between and connected to both said first and second safety locks and said rod connected to said second hook assembly.

7. The coupler as set forth in claim 5, further comprising:

a second lock arm movably connected to the frame, said second lock arm movable between a locked position and an unlocked position, wherein said second lock arm engages and retains said second safety lock in its engaged position when said second lock arm is in its locked position, said second lock arm selectively movable from its locked position to its unlocked position by contact between a portion of said second lock arm and the associated backhoe or excavator arm when the frame is moved to a curled position relative to the associated backhoe or excavator arm.

8. The coupler as set forth in claim 7, wherein said first and second lock arms are interconnected by a lock arm actuator pin such that said first and second lock arms and said lock arm actuator pin are part of a lock arm assembly, wherein said lock arm actuator pin is located adjacent the respective outer ends of the first and second lock arms and is adapted to contact the associated backhoe or excavator arm when said frame is moved to said curled position.

9. The coupler as set forth in claim 8, wherein said first and second lock arms are pivotally connected to said frame and said coupler further comprises at least one spring for biasing the first and second lock arms to their respective locked positions.

10. The coupler as set forth in claim 9, wherein said first and second safety locks are pivotally connected to said frame and pivot between their respective engaged and disengaged positions.

11. The coupler as set forth in claim 1, wherein:

said first safety lock is pivotally connected to said frame and pivots between its engaged and disengaged positions; and, said first lock arm is pivotally connected to said frame and said coupler further comprises a spring for biasing the first lock arm continuously toward its locked position.

12. The coupler as set forth in claim 11, wherein an inner end of said first lock arm includes a hooked portion that engages and retains a projecting tail portion of the first safety lock when the first safety lock is in its engaged position and the first lock arm is in its locked position.

13. The coupler as set forth in claim 2, wherein said upper portion of said frame comprises first and second parallel spaced-apart ribs each comprising first and second apertures that are respectively aligned with each other along respective first and second pin-on axes, and wherein said first hook assembly is fixed in position relative to said upper portion and said second hook assembly is movable relative to said upper portion and said first hook assembly.

14. The coupler as set forth in claim 13, wherein said second hook assembly is pivotally connected to said upper portion of said frame and pivots relative to said upper portion of said frame about said second pin-on axis.

15. An attachment coupler comprising:

a frame including a first hook adapted to mate with a first associated attachment pin and including a second hook adapted to mate with a second associated attachment pin, said second hook being movable toward and away from said first hook;

a safety lock movably connected to the frame and movable relative to the first hook between an engaged position where it blocks said first hook and a disengaged position where it opens said first hook;

an actuator operably connected between said second hook and said safety lock, said actuator adapted to move the second hook toward and away from the first hook and adapted to move the safety lock between its engaged and disengaged positions;

a lock arm movably connected to the frame and movable between a locked position and an unlocked position, wherein said lock arm engages and retains the safety lock in its engaged position when said lock arm is in its locked position, said lock arm selectively movable from its locked position to its unlocked position by contact between said lock arm and an associated backhoe or excavator arm when the frame is moved to a curled position.

16. The attachment coupler as set forth in claim 15, wherein said lock arm includes a hooked portion on an inner end that engages and retains a projecting tail portion of the safety lock when the safety lock is in its engaged position and said lock arm is in its locked position.

17. The attachment coupler as set forth in claim 15, wherein said frame comprises:

an aligned pair of first apertures located on a first pin-on axis and adapted to receive a first pin;

an aligned pair of second apertures located on a second pin-on axis and adapted to receive a second pin;

wherein said first hook is fixed in position relative to said first and second pin-on axes and said second hook is movable relative to both said first and second pin-on axes.

18. The attachment coupler as set forth in claim 17, wherein said second hook moves relative to said first hook by pivoting about said second pin-on axis.

19. The attachment coupler as set forth in claim 17, wherein said first and second hooks open outwardly away from each other in opposite directions.

* * * * *